US011208775B2

(12) United States Patent
Stinson

(10) Patent No.: US 11,208,775 B2
(45) **Date of Patent: *Dec. 28, 2021**

(54) PORTABLE ANIMAL WASTE COLLECTION AND STORAGE APPARATUS

(71) Applicant: Sandy Stinson, Santa Barbara, CA (US)

(72) Inventor: Sandy Stinson, Santa Barbara, CA (US)

( * ) Notice: Subject to any disclaimer, the term of this patent is extended or adjusted under 35 U.S.C. 154(b) by 50 days.

This patent is subject to a terminal disclaimer.

(21) Appl. No.: 16/914,840

(22) Filed: Jun. 29, 2020

(65) Prior Publication Data

US 2021/0095432 A1 Apr. 1, 2021

Related U.S. Application Data

(63) Continuation of application No. 16/698,290, filed on Nov. 27, 2019, now Pat. No. 10,711,417.
(Continued)

(51) Int. Cl.

| | |
|---|---|
| ***E01H 1/12*** | (2006.01) |
| ***B65F 1/14*** | (2006.01) |
| ***B65F 1/00*** | (2006.01) |
| ***B65F 1/16*** | (2006.01) |
| ***B65F 1/06*** | (2006.01) |

(52) U.S. Cl.
CPC ..... *E01H 1/1206* (2013.01); *B65F 1/002* (2013.01); *B65F 1/065* (2013.01); *B65F 1/1415* (2013.01); *B65F 1/1623* (2013.01); *E01H 2001/1286* (2013.01)

(58) Field of Classification Search
CPC ..... E01H 1/1206; E01H 2001/1286; B65F 1/1415; B65F 1/002; B65F 1/1623; B65F 1/065; B65F 1/06; B65F 2220/124; B65F 2240/136; B65F 2210/132
See application file for complete search history.

(56) References Cited

U.S. PATENT DOCUMENTS 3,985,409 A 10/1976 Kneier
4,205,869 A 6/1980 Mathis
(Continued)

OTHER PUBLICATIONS

Online Ad: Gladiator Dog Waste Station, https://www.terraboundsolutions.com/product/gladiator-dog-waste-station/, downloaded Dec. 13, 2018.

*Primary Examiner* — Stephen A Vu
(74) *Attorney, Agent, or Firm* — Guy Cumberbatch

(57) ABSTRACT

An apparatus for collecting and temporarily storing animal waste such as dog droppings includes a portable storage container with a pivoting lid movable between an open position and a closed position to keep contents dry. The container is adapted to receive and secure thereto a removable liner bag for easy disposal of the waste. A handle attached to the container pivots the lid open and closed with one position exposing the interior space from above for ease of adding and removing liner bags. A removable waste scooper is suspended from an outer wall of the container. The user need only touch the handle and a scooper when depositing droppings into the bag. The lid extends over an upper mouth of the container to prevent water from rain or sprinklers from seeping into the inner space. Custom compostable liner bags may be provided with lobes that are captured within bag retainers on front and rear walls.

20 Claims, 10 Drawing Sheets

Related U.S. Application Data

(60) Provisional application No. 62/906,531, filed on Sep. 26, 2019.

(56) References Cited

U.S. PATENT DOCUMENTS

| | | | |
|---|---|---|---|
| 4,982,863 | A | 1/1991 | Skillius |
| 5,169,018 | A | 12/1992 | Fiore |
| 5,419,452 | A | 5/1995 | Mueller |
| 5,511,682 | A | 3/1996 | Pace |
| 5,551,569 | A | 9/1996 | Garvin-Mazzarisi |
| 5,639,164 | A | 7/1997 | Ishino |
| 7,665,781 | B2 | 2/2010 | Drexler |
| 7,806,271 | B1 | 10/2010 | Kraska |
| 7,980,411 | B2 | 7/2011 | Kasbohm |
| 8,820,566 | B2 | 9/2014 | Ude |
| 8,944,274 | B2 | 2/2015 | Madrid |
| 9,078,417 | B1 | 7/2015 | Lees |
| 9,341,403 | B2 | 5/2016 | Conrad |
| 9,738,443 | B2 | 8/2017 | Ballard |
| 9,745,127 | B1 | 8/2017 | Stravitz |
| 9,745,128 | B2 | 8/2017 | Romano |
| 9,771,215 | B2 | 9/2017 | Rogers |
| 9,802,755 | B2 | 10/2017 | Chakravarthy |
| 9,834,376 | B1 | 12/2017 | Stravitz |
| 9,994,393 | B2 | 1/2018 | Dunn |
| 9,938,045 | B2 | 4/2018 | Morand |
| 9,944,460 | B2 | 4/2018 | Hon |
| 9,988,210 | B2 | 6/2018 | Buck |
| 10,006,180 | B2 | 6/2018 | Weber |
| 10,022,467 | B2 | 7/2018 | Chang |
| 10,053,283 | B1 | 8/2018 | Stravitz |
| 10,059,514 | B2 | 8/2018 | Bowen |
| 10,086,996 | B2 | 10/2018 | Dunn |
| 10,121,354 | B2 | 11/2018 | Starkey |
| 10,711,417 | B1 * | 7/2020 | Stinson ..... E01H 1/1206 |

* cited by examiner

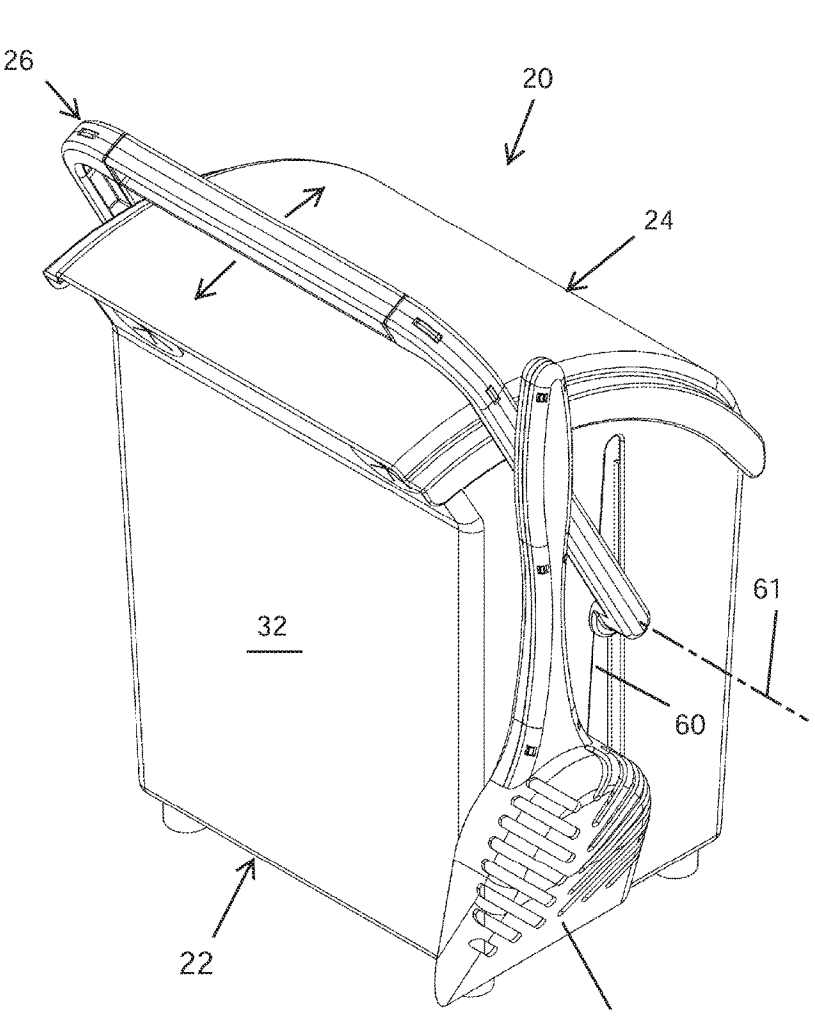
FIG. 1C
FIG. 2A
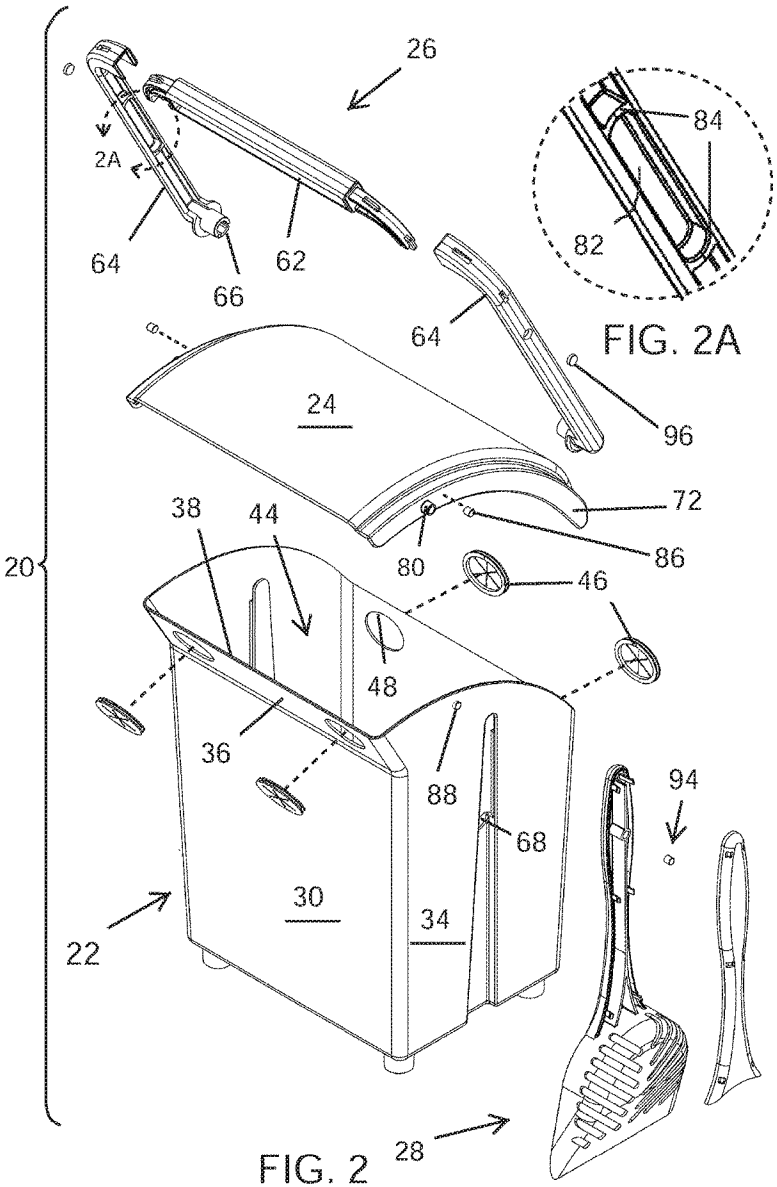
FIG. 2

PORTABLE ANIMAL WASTE COLLECTION AND STORAGE APPARATUS

RELATED APPLICATIONS

The present application is a continuation of U.S. application Ser. No. 16/698,290, filed Nov. 27, 2019, and now issued as U.S. Pat. No. 10,711,417, which claims priority under 35 U.S.C. 119 to U.S. Provisional application No. 62/906,531, filed Sep. 26, 2019, the disclosure of which is incorporated by reference herein.

FIELD OF THE INVENTION

The present invention is directed to a portable container for picking up and storing animal waste and, more particularly, to a storage container which is hygienic and simple to use.

BACKGROUND OF THE INVENTION

Devices for collecting and disposing of animal waste such as droppings come in various shapes and forms. Some devices include an elongated, linear shaft having a handle, and sometimes an operating control, at one end and a waste engaging and collecting mechanism at the second, opposed end. By manipulating the control mechanism with the collecting mechanism disposed adjacent the droppings, the animal waste may be collected and disposed of in a sanitary manner. Often people simply invert a small plastic or compostable bag and pick up the waste by hand, thereafter dropping the bag into a garbage can.

In the home or apartment setting, waste picked up from the yard must then be taken to the outside garbage can for disposal, which sometimes can be a significant distance. Night-time cleanup elevates the hassle.

There is thus a need for a convenient portable container for temporarily depositing waste between trips to the main garbage.

SUMMARY OF THE INVENTION

It is an object of the present invention to provide an improved container for collecting and storing animal waste. The container allows the user to scoop and deposit the animal waste directly into a convenient disposable bag retained within the container without having to touch any potentially dirty surfaces. The container has a lid which pivots closed to protect the interior from sprinkler, rain, or snow. The container features a number of bag retainers on exterior walls and shaped bags for close-fitting within the container. A convenient scoop for picking up the animal waste is removably secured on the exterior of the container.

A first embodiment of a portable animal waste collection and storage container, comprises a main body defining an inner space therein, an upper mouth of the main body defining convex side edges. The main body has bag retainers located below the upper mouth on both front and rear walls thereof that are adapted to secure upper edges of a disposable bag so as to suspend a main portion of a bag within the inner space. A control handle is arranged to pivot forward and rearward about a horizontal axis extending laterally through the main body. An arcuate upper lid having a concave lower contour matches the convex side edges such that the upper lid may slide smoothly over the upper mouth. The upper lid has a pair of cam pins extending laterally outward therefrom into inwardly-facing channels formed in the control handle so that pivoting movement of the control handle causes commensurate sliding movement of the upper lid over the upper mouth. Pivoting movement of the control handle displaces the upper lid between open and closed positions over the upper mouth of the main body, and the upper lid is spaced from a rear edge of the upper mouth when in the fully open position to facilitate removal and replacement of a disposable bag within the container held by the bag retainers.

The curvature of the arcuate upper lid and side edges is desirably centered at a location below the horizontal axis about which the control handle pivots, and the cam pins translate along and within the inwardly-facing channels in the control handle during pivoting of the control handle. In one embodiment, the upper mouth of the main body has an outwardly-angled front panel at an upper end of the front wall that terminates in a front lip, wherein when the main body is tilted to a horizontal orientation the front lip contacts the ground and the front wall is angled upward to retain waste within the inner space.

Additionally, the container has a shovel-like scooper detachably mounted on an outer surface of the control handle. The container main body may have a floor with gutters extending diagonally between the corners of the floor and a plurality of drainage holes near the center of the floor. Preferably, the lid in the closed position extends beyond the upper mouth of the main body with side rails overlapping side walls of the upper mouth and front and rear edges that are angled downward so as to direct water away from the inner space.

A second embodiment of a portable animal waste collection and storage container, comprises a main body having front, rear and side walls and a floor defining an inner space therein. And upper mouth of the main body defines convex side edges and has an outwardly-angled front panel at an upper end of the front wall that terminates in a front lip. When the main body is tilted to a horizontal orientation the front lip contacts the ground and the front wall is angled upward to retain waste within the inner space. In addition, the main body has bag retainers so as to suspend a main portion of a bag within the inner space. A control handle pivots forward and rearward about a horizontal axis extending laterally through the main body. An arcuate upper lid has a concave lower contour which matches the convex side edges such that the upper lid may slide smoothly over the upper mouth. The upper lid is engaged by the control handle so that pivoting movement of the control handle causes commensurate sliding movement of the upper lid over the upper mouth. Pivoting movement of the control handle displaces the upper lid between open and closed positions over the upper mouth of the main body. Moreover, the upper lid in the closed position extends beyond the upper mouth of the main body with side rails overlapping the side walls of the upper mouth and front and rear edges that are angled downward so as to direct water away from the inner space.

The upper lid in the second embodiment has a pair of cam pins extending laterally outward therefrom into inwardly-facing channels formed in the control handle so that pivoting movement of the control handle causes commensurate sliding movement of the upper lid over the upper mouth. Further, a curvature of the arcuate upper lid and side edges is centered at a location below the horizontal axis about which the control handle pivots, and the cam pins translate along and within the inwardly-facing channels in the control handle during pivoting of the control handle. Desirably, the main body has a floor with gutters extending diagonally between the corners of the floor and a plurality of drainage holes near the center of the floor.

Both the first and second embodiments of the container preferably also include a disposable bag with a main portion sized to fill the inner space and having four lobes at front and rear top corners that are sized to extend out of the main body and be secured by the bag retainers from the outside of the main body. The main body of the container may have a vertical column molded into each of left and right side walls that extends inward into the inner space of the container, and each column has a rounded top end which forms a groove adapted to receive and support a respective drawstring extending between front and rear lobes on the bag. The bag retainers in either container preferably comprise an outer frame with a plurality of flexible leaves extending inward and separated by slits, the leaves being configured to retain the bag lobes when the lobes are pushed through from one side to another. Desirably, the bag retainers have a circular frame and the slits between the leaves form a star shape, and wherein each bag retainer is press fit within a circular opening formed in either the front or rear wall of the main body.

Both the first and second embodiments of the container preferably include a shovel-like scooper detachably mounted on an outer surface of the control handle. Additionally, the main body desirably has a generally rectangular horizontal cross-section and gradually tapers wider as it gets higher so as to enable stacking of multiple main bodies. The main body of either container desirably has a height of between about 14-20 inches, and the handle extends upward from the lid between about 3-6 inches. In a taller version, the main body has a height of between about 14-20 inches, and the handle extends upward from the lid between about 8-14 inches.

A further understanding of the nature and advantages of the invention will become apparent by reference to the remaining portions of the specification and drawings.

BRIEF DESCRIPTION OF THE DRAWINGS

Features and advantages of the present invention will become appreciated as the same become better understood with reference to the specification, claims, and appended drawings.

FIGS. 1A-1C are perspective views of the animal waste collecting and storage container of the present application;

FIG. 2 is an exploded perspective view of the collecting and storage container;

DETAILED DESCRIPTION OF THE PREFERRED EMBODIMENTS

The present application is directed to an improved portable collecting and storage container for animal waste which enables a homeowner or apartment/condo management company to place convenient receptacles around and exterior of the building for temporarily collecting and storing animal waste. The container receives a disposable bag therein into which the animal waste is placed. A convenient scoop attached to an exterior of the container is used to pick up the animal waste, and a handy operating handle enables the user to pivot open an upper lid for dropping animal waste into the disposable bag.

Figure 1B:
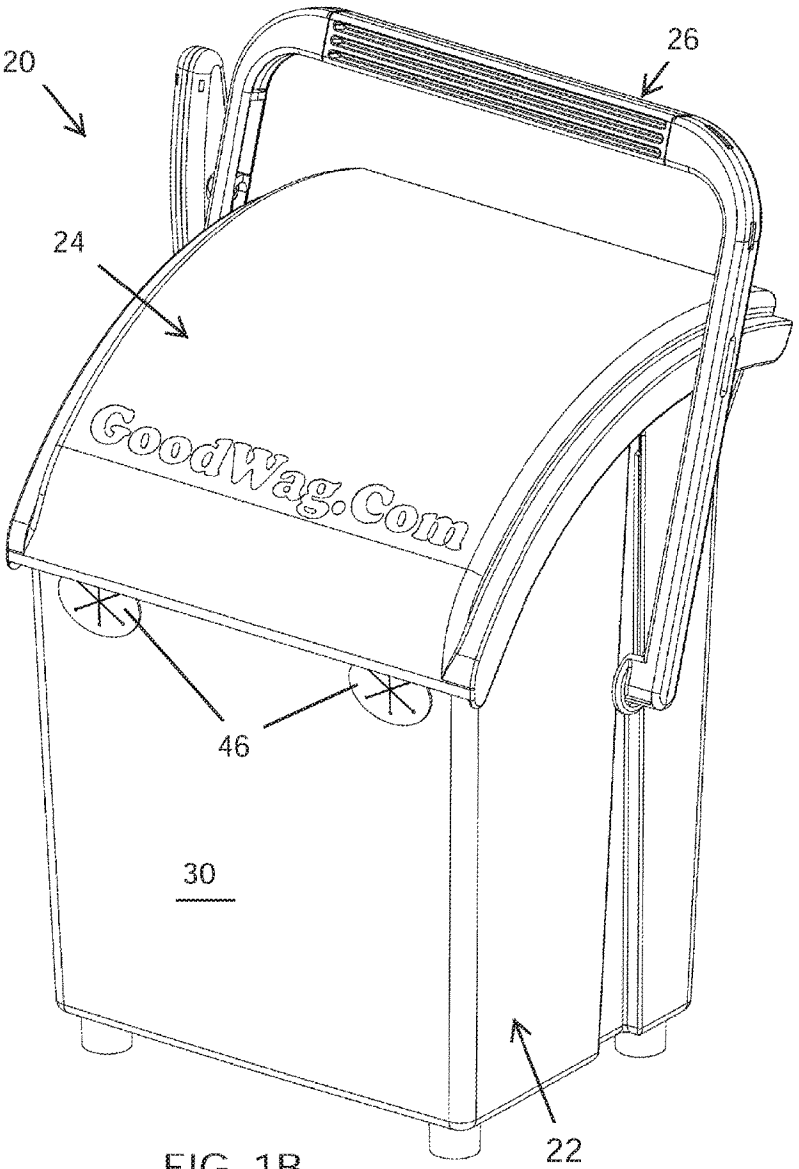
Figure 1A:
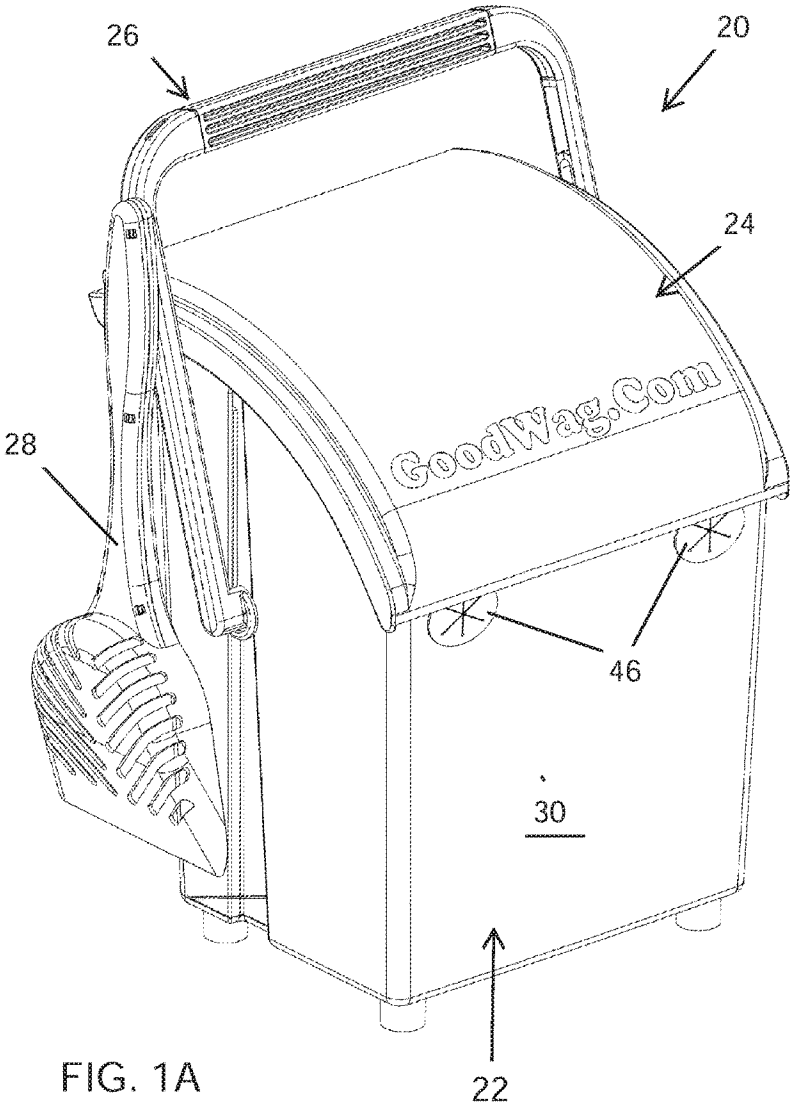

FIGS. 1A-1C are perspective views of the animal waste collecting and storage container 20 of the present application, while FIG. 2 shows the container exploded. The container 20 comprises four main elements: a container main body 22, an upper lid 24 arranged to pivot over an open upper mouth of the main body, a control handle 26, and a shovel-like scoop or scooper 28. Preferably, the components of the container 20 are molded from a suitable plastic such as polypropylene, though other materials are contemplated. The material is a tough and not brittle polymer, as with most trash cans.

Figure 3B:
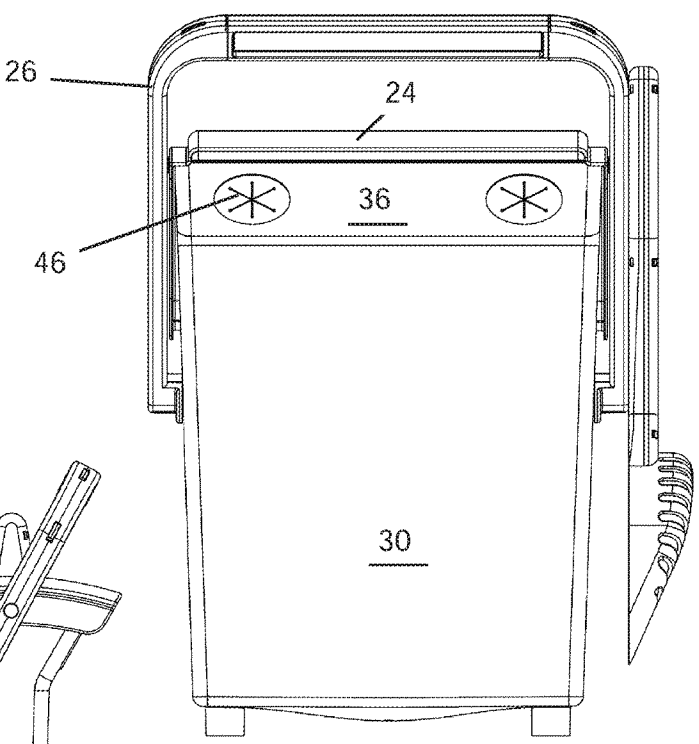
FIGS. 3A-3C are front, rear and left side elevational views of the collecting and storage container with a pivoting lid shown in a closed position.
Figure 3A:
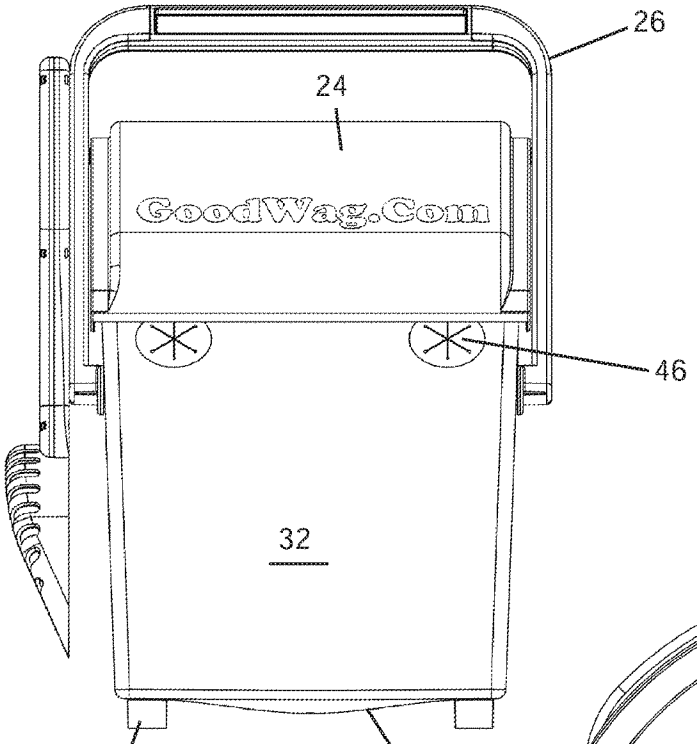
Figure 3C:
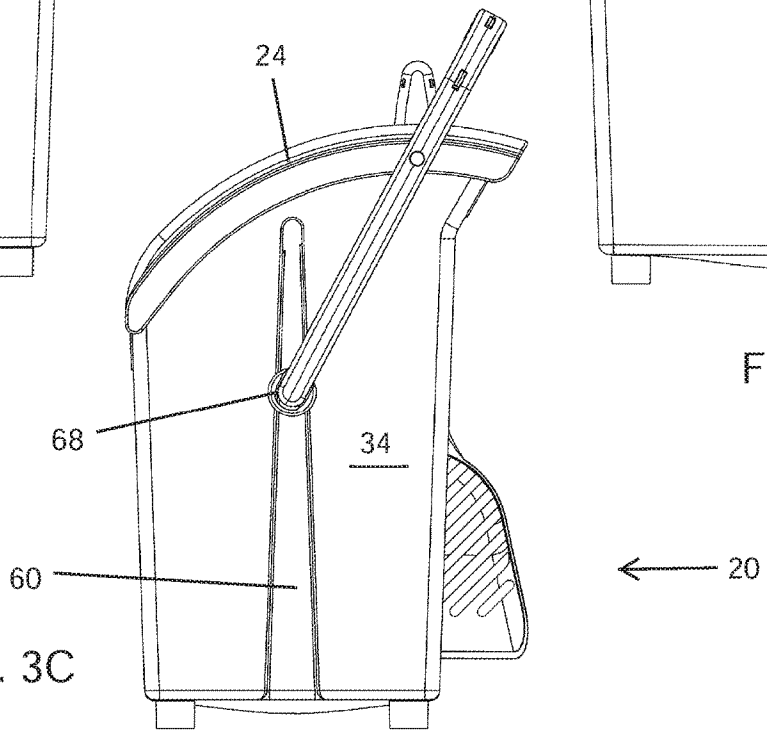

With reference also to the front, rear and left side elevational views of FIGS. 3A-3C, the container main body 22 is generally arranged in a rectilinear three-dimensional shape, with a generally-vertical front wall 30 opposite a rear wall 32, and having two substantially identical side walls 34. Each of the walls 30, 32, 34 are generally vertical or slightly tapered away from each other as they rise higher (to enable stacking for shipping), though an outwardly-angled front panel 36 extends upward from the front wall 30 and terminates in a front lip 38. In a preferred embodiment, the main body 22 has a height of between 14-20 inches, and more preferably about 16 inches, and the handle 26 has a length of between 10-16 inches, and more preferably about 11.5 inches.

Figure 3E:
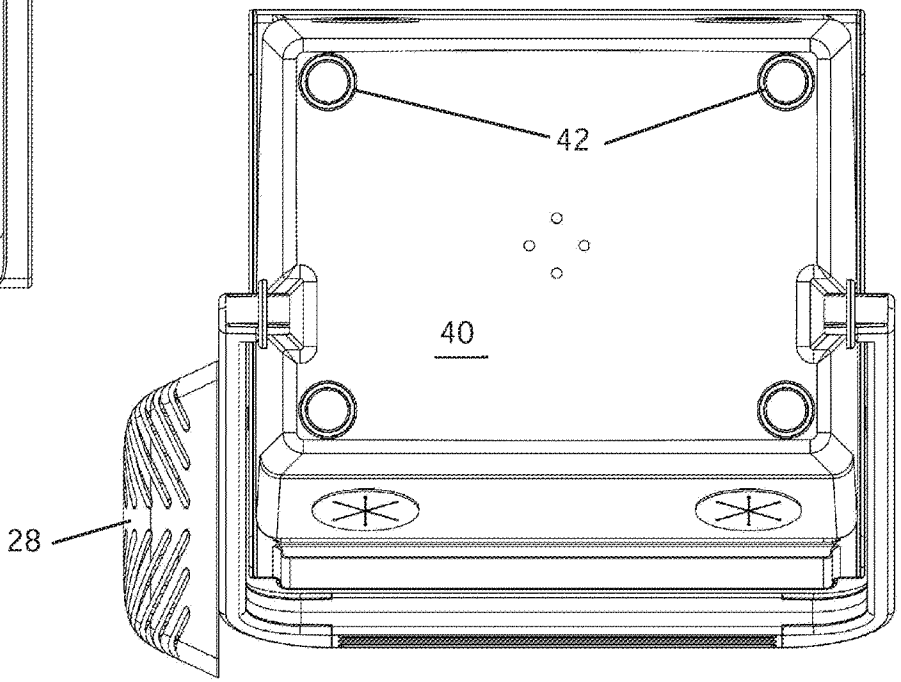
FIGS. 3D and 3E are top and bottom plan views of the collecting and storage container.
Figure 3D:
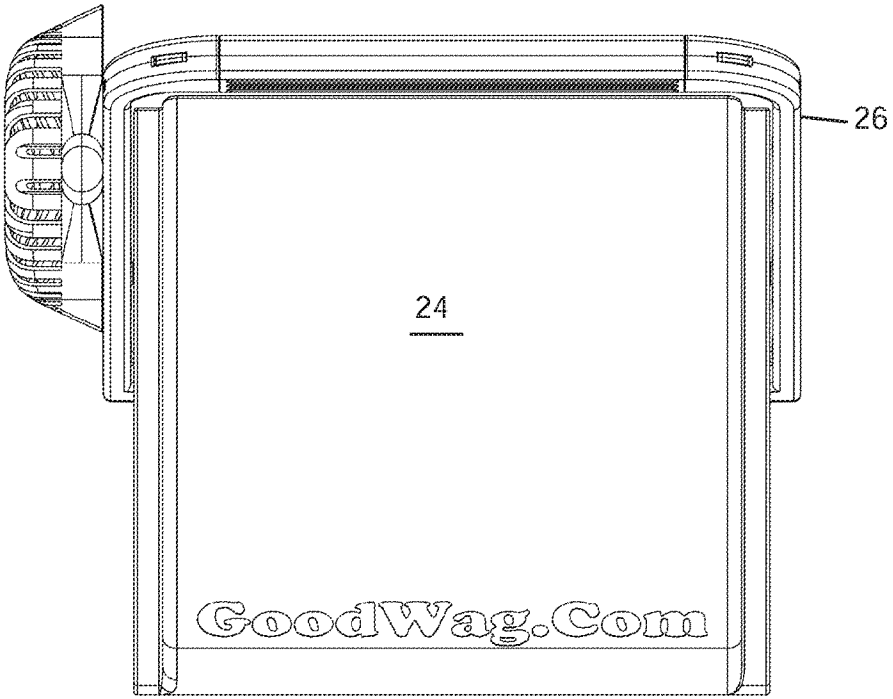

An upper mouth of the container main body 22 is defined by the upper edges of the rear and side walls 32, 34 in combination with the front lip 38. A lower floor 40 of the container main body 22 is seen in FIG. 3E and is elevated above the ground by a plurality of short, cylindrical feet 42, preferably four, which extend downward from outer corners of the main body.

An inner space 44 is defined within the walls of the main body 22 and above the lower floor 40. In a preferred embodiment, the volume of the inner space 44 is between about 4-6 gallons, requiring a bag liner of roughly 17 inches wide by 18 inches tall. Of course, other dimensions are possible, the volume of the inner space 44 desirably being large enough to accept a number, possibly a dozen, of individual deposits of animal waste before becoming full, while at the same time having a relatively small size so as to be easily transported by hand and be placed in a convenient location without being overly obtrusive. The total weight of the empty container 20 is about 2.5 lbs, making the lifting, manipulation and transport easy for most people.

The container main body 22 preferably has bag retaining devices surrounding the upper mouth which receive and retain free upper ends of a disposable bag so as to suspend the bag within the inner space 44. In the illustrated embodiment, four generally circular disk-like retainers 46 are press fit or adhered into circular openings 48 formed in both the rear wall 32 and the front angled panel 36. Each pair of circular openings 48 are spaced the full width of the respective wall apart from each other so as to spread apart the locations at which the bag is retained. In the preferred embodiment, the retainers 46 comprise flexible leaves defined by a star- or spoke-shaped pattern of lines cut through flexible, preferably polymeric, material within a rigid outer circular frame.

Figure 9:
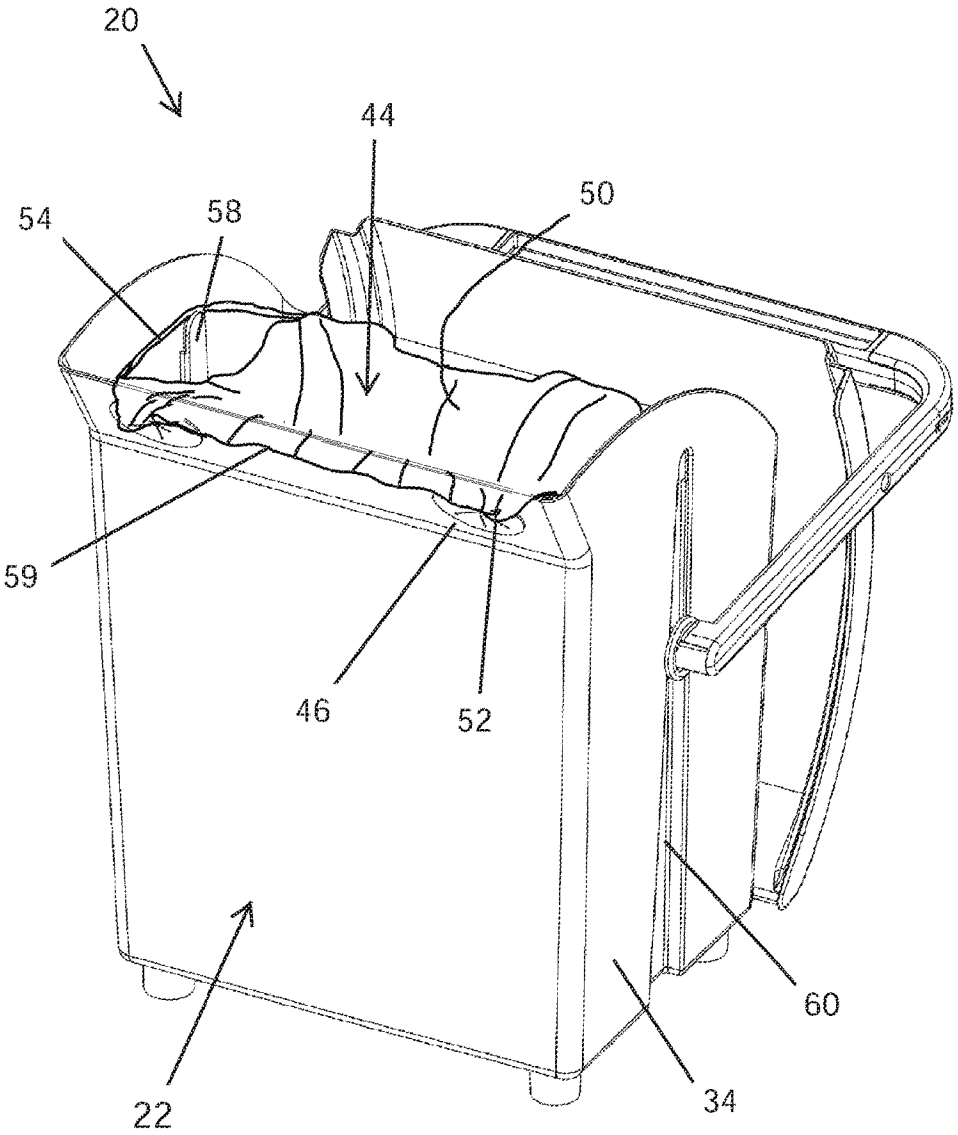
FIG. 9 is a perspective view of a disposable bag secured within retainers provided in the container.
Figure 8:
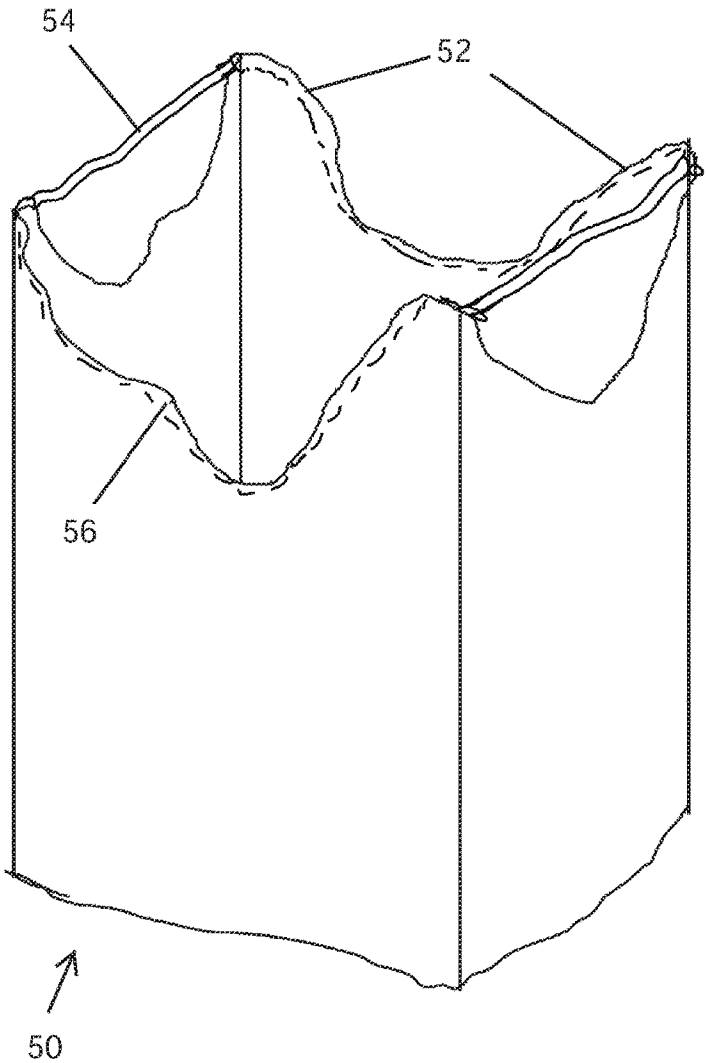
FIG. 8 is a perspective view of an exemplary disposable bag for use with the collecting and storage container.

With reference to FIGS. 8 and 9, an exemplary disposable bag 50 is shown which has a plurality of lobes 52 extending upward from four upper corners. The bag 50 is desirably made of a compostable material. Each of the lobes 52 may be separately extended around the upper mouth of the container main body 22 and pressed into the retainers 46, as seen in FIG. 8. Because the leaves of the retainers 46 are flexible, the lobes 52 of the bag 50 are easily pressed past and retained therein. Furthermore, the leaves are sufficiently flexible so as to easily enable easy removal of the lobes 52 from the retainers 46. Of course, alternative retainers such as hooks, clips or the like maybe utilized with bags that have loop-shaped handles rather than lobes.

FIG. 9 shows the bag 50 secured within the container main body 22. As explained, two of the lobes 52 extend outward over the front lip 38 (FIG. 5A) of the main body to be secured by pushing them through the leaves of the two front retainers 46. The bag 50 is shaped such that a front edge 59 thereof extends over the width of the front lip 38 to help keep the main body 22 free of animal waste.

The exemplary bag 50 preferably also has a pair of drawstrings 54 which extend through an elongated pocket formed 56 along front and rear top edges of the bag and emerge and cross over between two lobes 52 on each side, as shown. The drawstrings 54 are each positioned to be retained over a vertical column 58 molded into the side walls 34 and extending inward into the inner space 44 of the container. Each column 58 has a rounded top end which forms a groove in which the respective drawstring 54 is hung. The columns 58 are defined by the mirror image of a vertical channel 60 formed on the exterior of the side walls 34, whose interaction with the control handle 26 will be described below. The securement of the bag 50 by the four lobes 52 in the retainers 46 as well as looping the drawstrings 54 over the columns 58 holds the bag within the inner space 44 while making removal easy—one need only grasp the drawstrings 54 and pull upward, with the top edge of the bag being cinched closed.

With reference back to FIGS. 1-4, movement of the versatile control handle 26 will be described. In general, the handle 26 provides a convenient carry handle as well as a sanitary control of the opening and closing of the upper lid 24. The control handle 26 pivots forward and backward in a vertical plane relative to the main body 22 about an axis 61, seen in FIG. 1C. Depending on where the axis 61 is located, the handle 26 sticks up anywhere between 5-8 inches up from the lid 24, allowing plenty of space to grasp the handle without touching the main body 22 or lid 24.

As seen exploded in FIG. 2, the control handle 26 preferably includes three sections: a central bridge section 62 flanked by identical arms 64. The lateral ends of the bridge section 62 and the top ends of the arms 64 are molded to have complementary tongue-and-groove style connections with mating tabs which are both inexpensive to fabricate and simple to assemble via a snap-fit or adhesive. The sections 62, 64 are also molded to have a C-channel cross-section for strength combined with cost and weight savings. A pivot shaft stub 66 projects inwardly at the lower end of each arm 64 and engages a throughbore or bushing 68 formed in each side wall 34; in particular within each of the vertical channels 60. Each shaft stub 66 preferably has one or more pawls on flexible fingers which flex inward when pushed through the respective bushing 68 and spring back out again to secure that arm 64 to the main body 22. Alternatively, the shaft stub 66 may be removable from the bushing 68, such as by providing a keyed engagement which may be detached in a particular rotational position of the handle 26.

Figure 4B:
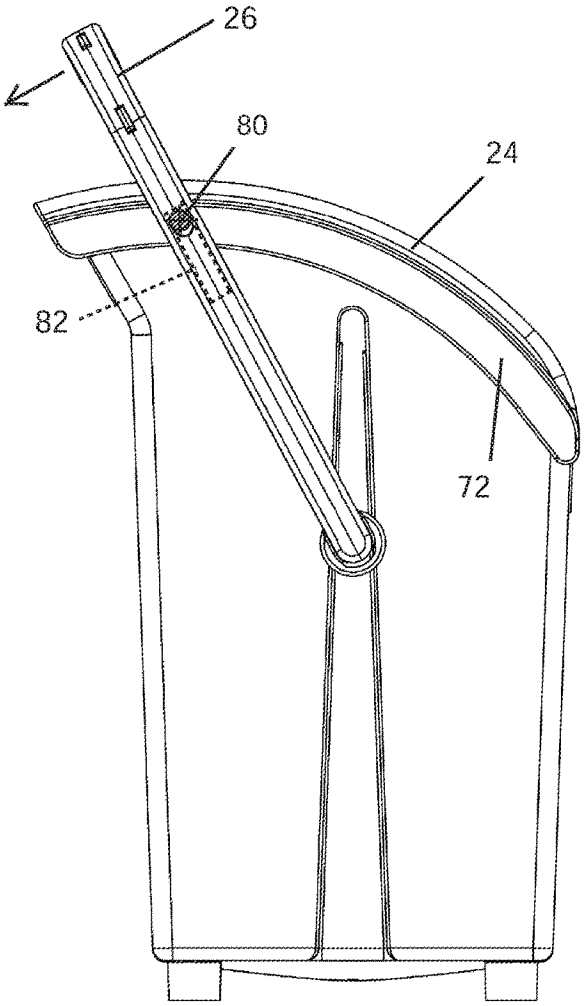
FIGS. 4A and 4B are right side elevational views of the collecting and storage container with a handle in upright and forward pivot positions.
Figure 4A:
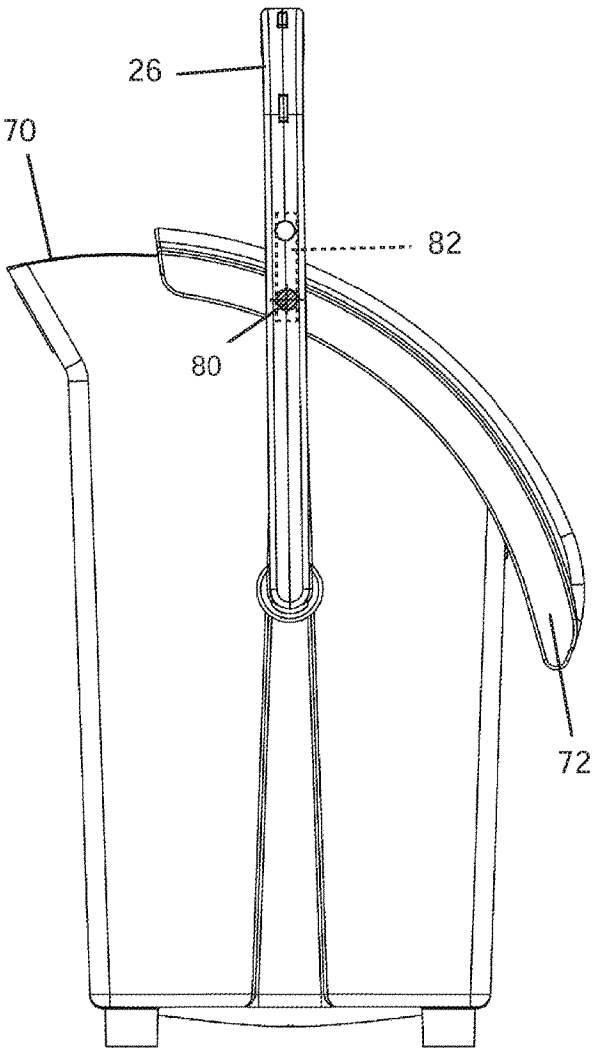
Figure 5B:
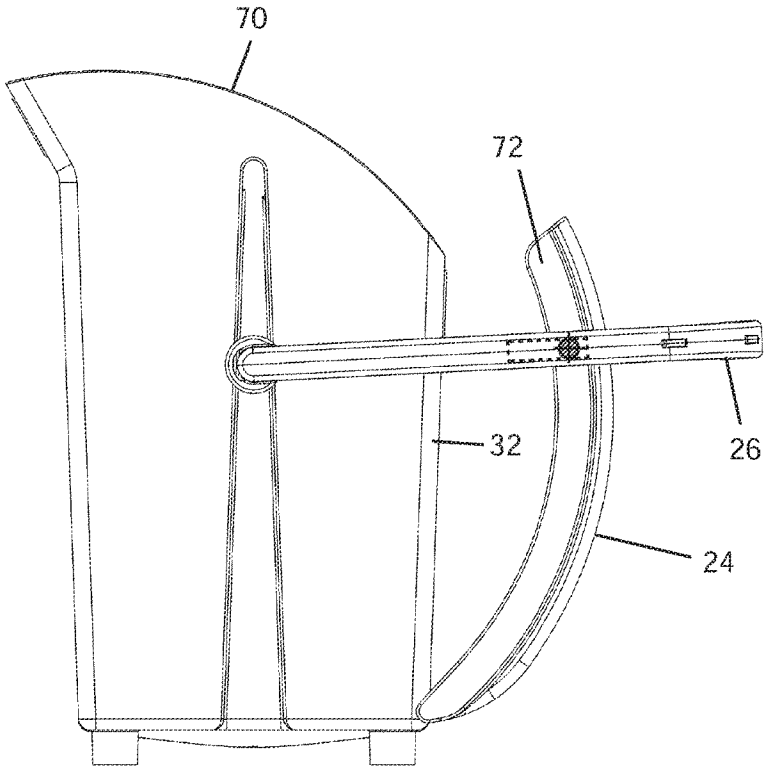
FIGS. 5A and 5B are perspective and left side elevational views of the collecting and storage container with a handle in a rearward pivot position and an upper lid open to expose an interior within the container for depositing animal waste and replacing a disposable bag therein.

The control handle 26 engages the upper lid 24 and displaces it over the upper mouth of the container main body 22, as seen in the side views of FIGS. 4A, 4B and 5B. The upper lid 24 has a concave-down shape which slides smoothly over convex upper edges 70 of the side walls 34, best seen in FIG. 5A. In particular, the lid 24 is formed with two outer rails 72 that are spaced just wider than the width dimension of the main body 22, and horizontal ledges 74 just inward from the rails which contact and slide over the convex upper edges 70. The outer rails 72 function in a similar manner to the wheels of a train, holding the lid from any lateral movement while sliding over the upper mouth. Moreover, as mentioned elsewhere, the rails 72 overlap and extend downward past the upper mouth, channeling water to the outside of the main body 22 when closed.

Referring back to FIG. 2 and the enlargement of FIG. 2A, small sliding cam pins 80 extend outward from both of the outer rails 72 of the lid 24 and engage inner channels 82 in the handle arms 64 (FIG. 2A). The inner channels 82 are defined between two stops 84 along each arm, thus limiting the relative sliding extent of the cam pins 80 along the handle arms 64. In general, pivoting movement of the control handle 26 carries the lid 24 with it, though with some relative sliding movement therebetween.

As seen in FIGS. 4A and 4B, the otherwise hidden cam pin 80 is indicated by a fiducial, and the channel 82 is shown in dashed line. Between the partially open position of FIG. 4A and the closed-lid position of FIG. 4B, the cam pin 80 slides upward in the channel 82. In the completely open position of FIG. 5B, the cam pin 80 likewise is near the top of the channel 82. This relative movement or "slop" between the lid 24 and the control handle 26 is needed to prevent binding therebetween and ensure smooth sliding of the lid. That is, the curvature of the lid 24 and the convex upper edges 70 of the main body 22 is not centered at the pivot axis of the control handle 26, and thus some relative sliding therebetween is required. In particular, the curvature of the lid 24 and the convex upper edges 70 is centered at a location below the axis 61 about which the control handle 26 pivots.

It should be noted that although the lid 24 is partly open when the handle 26 is upright in FIG. 4A, as when carrying the container 20, the positions of the cam pins 80 in the lid 24 could be adjusted so that the lid is closed when carrying the container. However, the illustrated embodiment enables the lid to be completely retracted rearward, as seen in FIGS. 5B and 7B, so that the upper mouth of the main body 22 is completely open. This is beneficial when collecting animal waste with the main body 22 tipped on its side, as in FIG. 7B.

At this point attention is drawn to two small magnets 86 that may be provided in the outer rails 72 of the lid 24 which align with two small magnets 88 affixed near the top edge of each of the side walls 34. These magnets help hold the lid 24 in the closed position, seen in FIG. 4B, and resist inadvertent movement from, for example, wind. However, the attractive force of the magnets is relatively small such that sliding movement of the lid 24 from pivoting of the handle 26 is not impeded. It should also be noted that the lid 24 pivots closed completely covering the upper mouth of the main body 22 to protect the interior from sprinkler spray, rain, snow, etc. The arcuate shape of the lid 24 ensures that both front and rear edges are angled downward, thus channeling water to the ground as opposed to back into the container. Furthermore, the outer rails 72 on the side edges of the lid 24 extend downward past and overlap the upper mouth, again preventing ingress of water. This is extremely important to avoid saturating the contents of the container, thus avoiding what could be a complete mess.

Figure 5A:
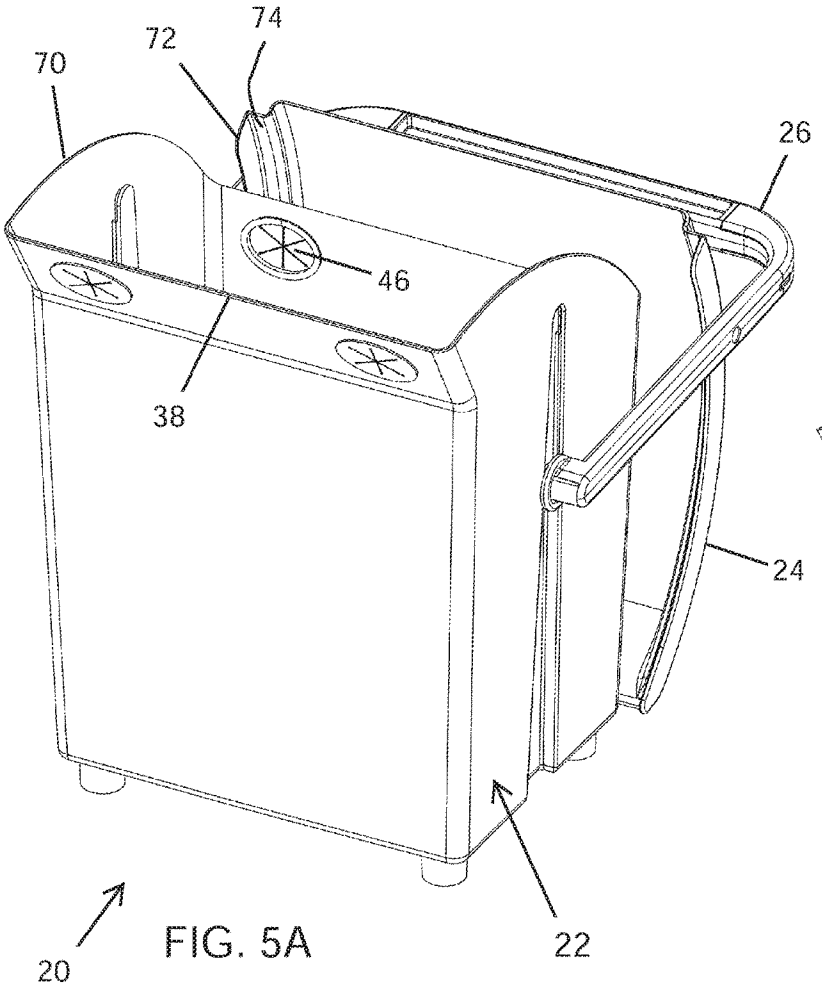

FIGS. 5A and 5B show the collecting and storage container 20 with the handle 26 pivoted rearward to displace the upper lid 24 to a completely or fully open position and expose the inner space 44 within the container when replacing a disposable bag therein. To facilitate this operation, a separation is created between the forward edge of the upper lid 24 and the rear upper edge of the container main body 22. Thus, the user can easily remove the previous disposable bag 50 (see FIG. 9) and replace it with another, with the lid 24 being completely removed as an impediment to pressing the lobes 54 of the bag into the retainers 46 in the rear wall 32. The rear edge of the lid 24 is seen in contact with the lower edge of the rear wall 32 in FIG. 5B which prevents it from touching the ground and helps keep it clean.

Figure 6:
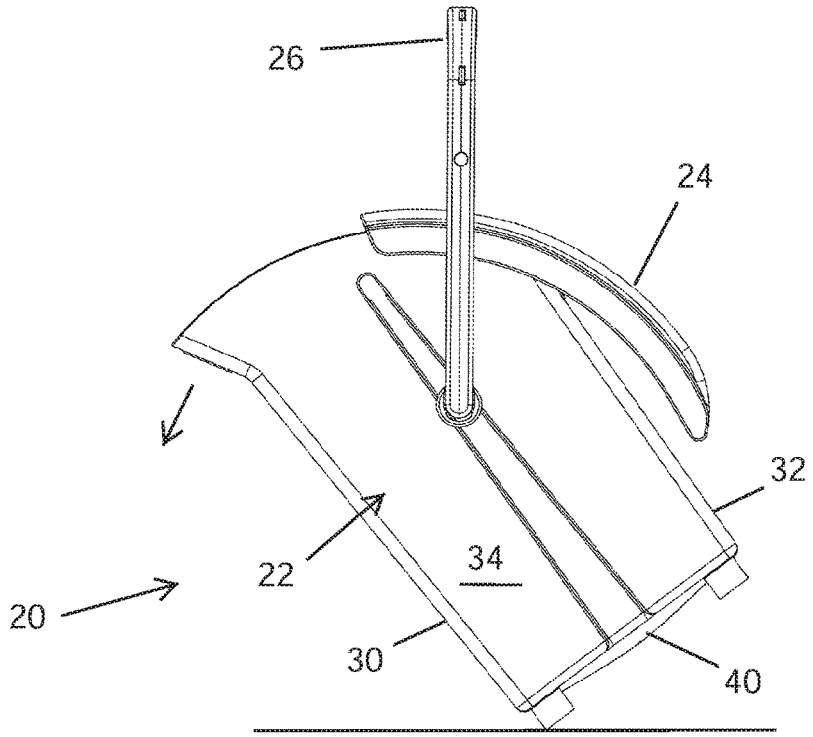
FIG. 6 is a left side elevational view of the collecting and storage container shown in the process of tipping the container forward.

FIG. 6 illustrates the collecting and storage container 20 in the process of tipping forward, such as when lying the container horizontal to facilitate introduction of large amounts of waste or other materials or when cleaning the inside of the main body 22. (Indeed, the present container may be used as a waste receptacle in general and this position acts much like a dustpan.) To reach this position, the use need only pull the control handle 26 forward to start the main body 22 leaning forward, and the lid 24 automatically opens as the main body tilts.

Figure 7A:
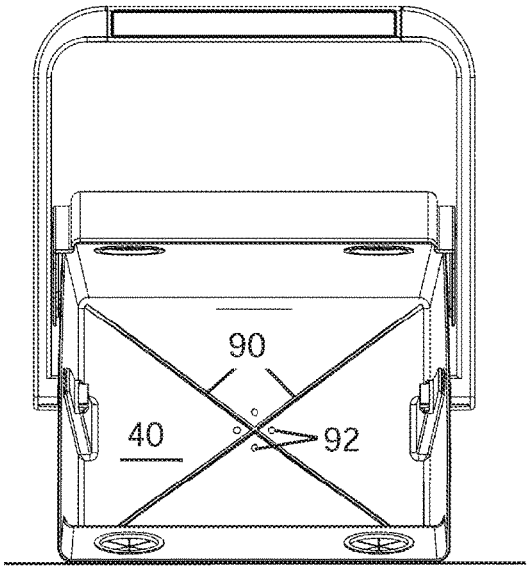
FIGS. 7A and 7B are top plan and left side elevational views of the container after having been completely tipped forward so that a top front edge rests on the ground for scooping animal waste directly into the container.
Figure 7B:
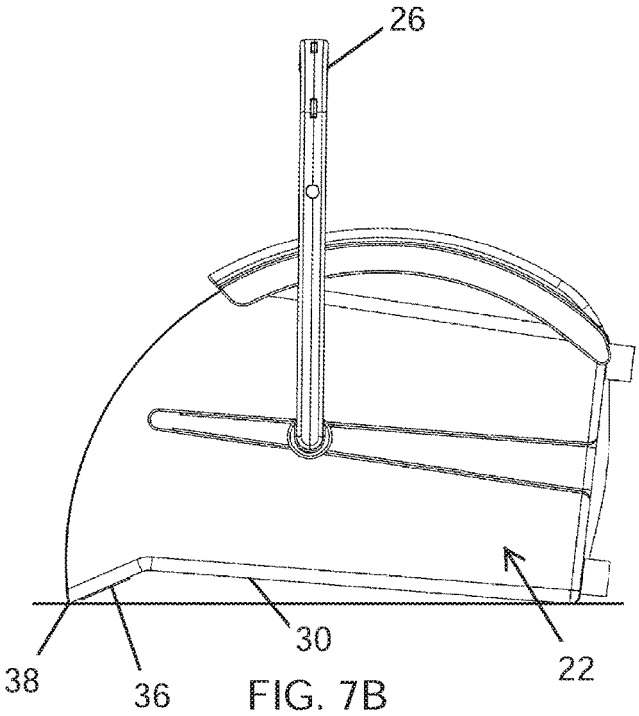

FIGS. 7A and 7B show the container 20 horizontal or sideways after the main body 22 is completely tipped forward so that the front lip 38 rests on the ground. The angled front panel 36 elevates the top edge of the main body 22 such that a majority of the front wall 30 is tilted. This helps prevent waste or individual waste bags within the container from rolling out. Once in the sideways position of FIG. 7B, the user may easily scoop animal waste directly into the liner bag 50 inside the container main body 22. Preferably, as seen in FIG. 9, the front edge 59 of the bag 50 desirably extends over the width of the front lip 38 so that no waste can drop down into the inner space 44 of the container, thus keeping the mess contained in the bag. This horizontal orientation is extremely efficient when picking up animal waste, especially multiple piles. The user need only shift the location of the container 20 around the yard and scoop the waste directly into the inner space 44. This is also a convenient tool/method for cleaning waste from kitty litter boxes. The control handle 26 may be left balanced in the vertical position as shown with the lid 24 in contact with the main body 22, which is convenient for manipulation and subsequent pickup.

FIG. 7A also shows a drainage slope in the lower floor 40 of the main body 22 defined by intersecting gutters 90 extending diagonally between the corners of the floor. Any fluid from condensation or the like is channeled down the gutters 90 toward a plurality of drainage holes 92 near the center of the floor 40.

With reference now back to FIG. 2, the container 20 is provided with the convenient scoop 28 which hangs on one side. More particularly, the scoop 28 is preferably molded in two pieces and a small primary magnet 94 is secured therein. The magnet 94 is attracted to a secondary magnet 96 affixed to an outer lateral surface of one of the handle arms 64. Thus, the scoop 28 may be temporarily suspended from the handle arm 64, as seen in FIGS. 1A-1C. Desirably, secondary magnets 96 are provided on both arms 64 so that the scoop 28 can be positioned on either lateral side of the container. The scoop 28 thus moves with the handle, which would otherwise knock the scoop off if the scoop were secured directly to the main body 22.

Figure 10A:
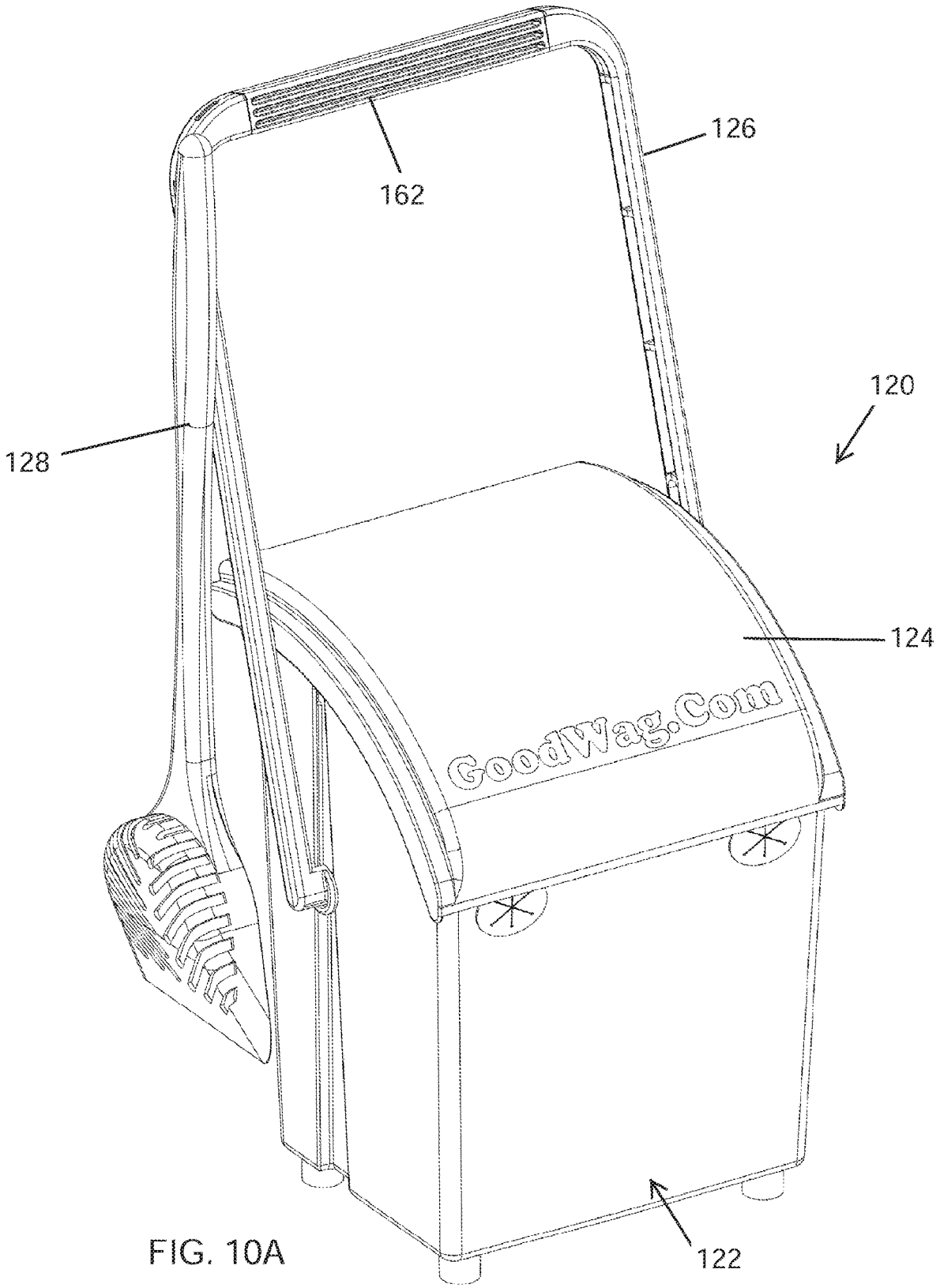
FIGS. 10A and 10B are perspective views of an alternative animal waste collecting and storage container having an extended handle.
Figure 10B:
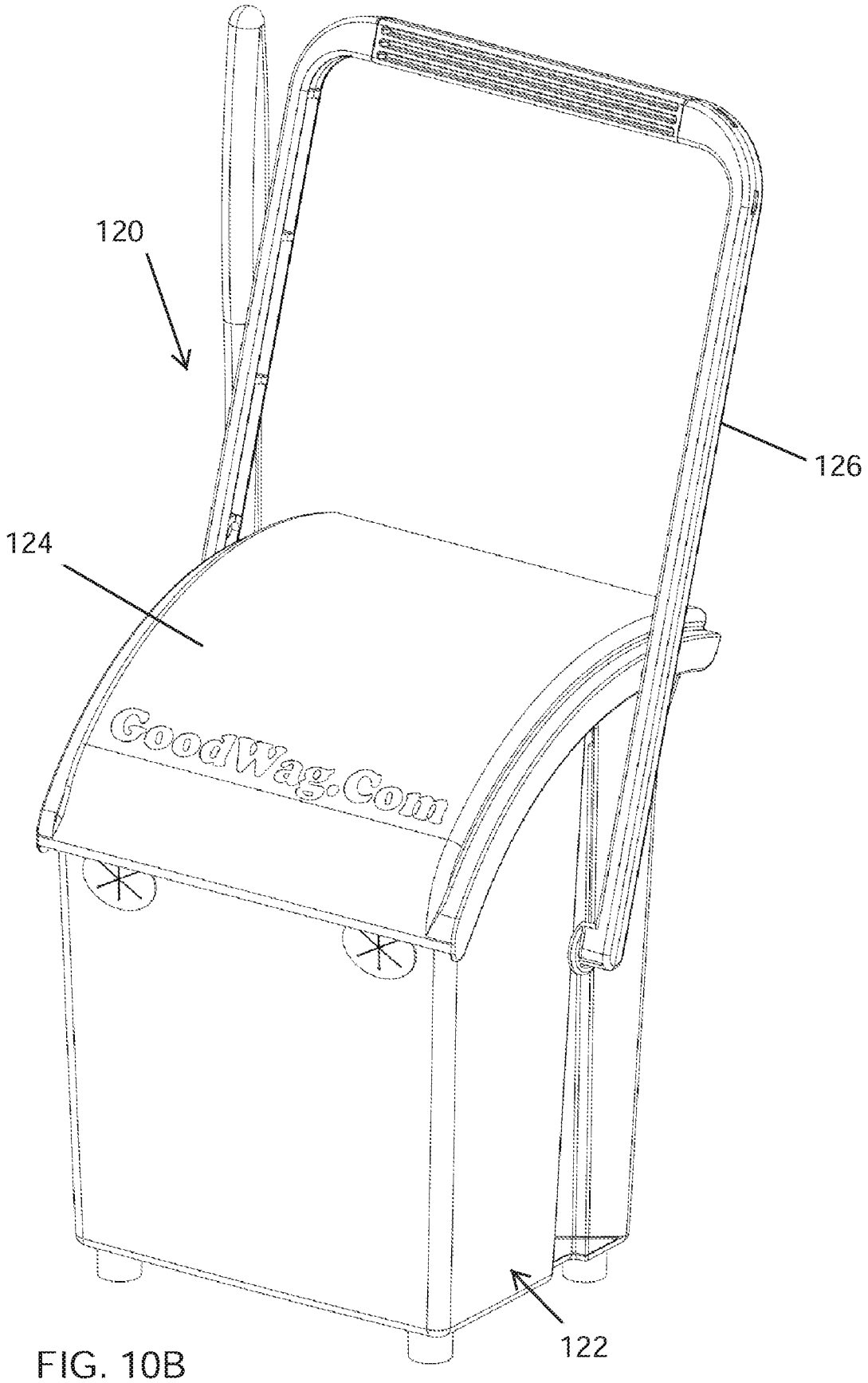

FIGS. 10A and 10B are perspective views of an alternative animal waste collecting and storage container 120 having an extended handle 126. The main body 122 and lid 124 are substantially the same as described above for the first embodiment. The handle 126 has an extended length so that a user need not bend over so far when tilting and otherwise manipulating the container. In a preferred embodiment, the main body 122 preferably has a height of between 14-20 inches, and more preferably about 16 inches, and the handle 126 has a length of between 14-20 inches, and more preferably about 19.5 inches. Depending on where the horizontal axis of the handle is located, the handle 126 sticks up anywhere between 8-14 inches from the lid 124 to a total height of between 24-36 inches, allowing a user to easily grasp the handle and tip the main body 122 on its side without even bending over. In the preferred embodiment the main body 122 height is 16 inches, the handle length is 19.5 inches, and the handle is mounted so that the central bridge section 162 of the handle rises to a height of about 28 inches. The handle of the scoop 128 is likewise extended to around 19 inches to further facilitate the task of collecting the waste without stooping over.

CONCLUSION

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. With regard to flowcharts, if present, additional and fewer steps may be taken, and the steps as shown may be combined or further refined to achieve the methods described herein. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

Those skilled in the art will appreciate that various changes and modifications may be made to the preferred embodiments, the invention in its broader aspects is not limited to the specific details, representative devices, and illustrative examples shown and described.

It is claimed:

1. A portable animal waste collection and storage container, comprising:

a main body having vertical side walls, a front wall, a rear wall and a floor together defining an inner space therein, an upper mouth of the main body defining convex side edges, wherein the upper mouth of the main body has an outwardly-angled front panel at an upper end of the front wall that terminates in a front lip, wherein when the main body is tilted to a horizontal orientation the front lip contacts the ground and the front wall is angled upward to retain waste within the inner space;

a control handle arranged to pivot forward and rearward about a horizontal axis extending laterally through the main body; and an arcuate upper lid having a concave lower contour which matches the convex side edges such that the upper lid may slide smoothly over the upper mouth, the upper lid having a pair of cam pins extending laterally outward therefrom into inwardly-facing channels formed in the control handle so that pivoting movement of the control handle causes commensurate sliding movement of the upper lid over the upper mouth, and wherein pivoting movement of the control handle displaces the upper lid between open and closed positions over the upper mouth of the main body, and wherein the upper lid is spaced from a rear edge of the upper mouth when in a fully open position to facilitate removal and replacement of a disposable bag within the container.

2. The container of claim 1, wherein a curvature of the arcuate upper lid and side edges is centered at a location below the horizontal axis about which the control handle pivots, and the cam pins translate along and within the inwardly-facing channels in the control handle during pivoting of the control handle.

3. The container of claim 1, wherein the lid has vertical side rails that overlap the side edges of the main body, and further including lid magnets located in the side rails and main body magnets located in the side edges of the main body that are positioned to retain the lid in the closed position.

4. The container of claim 1, further including bag retainers located below the upper mouth on both the front and rear walls thereof, the bag retainers adapted to secure upper edges of a disposable bag so as to suspend a main portion of a bag within the inner space.

5. The container of claim 4, further including a disposable bag with a main portion sized to fill the inner space and having four lobes at front and rear top corners that are sized to extend out of the main body and be secured by the bag retainers from the outside of the main body.

6. The container of claim 4, wherein the bag retainers comprise an outer frame with a plurality of flexible leaves extending inward and separated by slits, the leaves being configured to retain the bag lobes when the lobes are pushed through from one side to another.

7. The container of claim 1, further including a dog poop scooper detachably mounted on an outer surface of the control handle.

8. The container of claim 1, wherein the main body has a floor with gutters extending diagonally between the corners of the floor and a plurality of drainage holes near the center of the floor.

9. The container of claim 1, wherein the lid in the closed position extends beyond the upper mouth of the main body with side rails overlapping side walls of the upper mouth and front and rear edges that are angled downward so as to direct water away from the inner space.

10. The container of claim 1, wherein the main body has a height of between about 14-20 inches, and the handle extends upward from the lid between about 8-14 inches.

11. A portable animal waste collection and storage container, comprising:

a main body having vertical side walls, a front wall, a rear wall and a floor together defining an inner space therein, an upper mouth of the main body defining side edges;

a control handle arranged to pivot forward and rearward about a horizontal axis extending laterally through the main body; and an upper lid having a lower contour which matches the side edges of the main body, and the upper lid and upper mouth cooperate such that the upper lid may slide smoothly over the upper mouth, the upper lid being engaged by the control handle so that pivoting movement of the control handle displaces the upper lid to cause sliding movement of the upper lid over the upper mouth, and wherein pivoting movement of the control handle displaces the upper lid between open and closed positions over the upper mouth of the main body, and wherein the upper lid in the closed position extends beyond the upper mouth of the main body with side rails overlapping and extending downward below the side edges of the upper mouth and front and rear edges that are both angled downward so as to direct water away from the inner space.

12. The container of claim 11, wherein the upper lid has a pair of cam pins extending laterally outward therefrom into inwardly-facing channels formed in the control handle so that pivoting movement of the control handle causes commensurate sliding movement of the upper lid over the upper mouth, wherein the upper lid has a curvature that matches a curvature of the side edges, and the curvature is centered at a location below the horizontal axis about which the control handle pivots, and the cam pins translate along and within the inwardly-facing channels in the control handle during pivoting of the control handle.

13. The container of claim 11, wherein the main body has four bag retainers located below the upper mouth on both the front and rear walls thereof so as to suspend a main portion of a bag within the inner space, further including a disposable bag with a main portion sized to fill the inner space and having four lobes at front and rear top corners that are sized to extend out of the main body and be secured by the bag retainers from the outside of the main body.

14. The container of claim 13, wherein the bag retainers comprise an outer frame with a plurality of flexible leaves extending inward and separated by slits, the leaves being configured to retain the bag lobes when the lobes are pushed through from one side to another.

15. The container of claim 11, wherein the lid has vertical side rails that overlap the side edges of the main body, and further including lid magnets located in the side rails and main body magnets located in the side edges of the main body that are positioned to retain the lid in the closed position.

16. The container of claim 11, further including a dog poop scooper detachably mounted on an outer surface of the control handle.

17. The container of claim 11, wherein the main body has a floor with gutters extending diagonally between the corners of the floor and a plurality of drainage holes near the center of the floor.

18. The container of claim 11, wherein the main body has a height of between about 14-20 inches, and the handle extends upward from the lid between about 8-14 inches.

19. The container of claim 11, wherein the main body has a generally rectangular horizontal cross-section and gradually tapers wider from the floor toward the upper mouth so as to enable stacking of multiple main bodies.

20. The container of claim 11, wherein the upper mouth of the main body has an outwardly-angled front panel at an upper end of the front wall that terminates in a front lip, wherein when the main body is tilted to a horizontal orientation the front lip contacts the ground and the front wall is angled upward to retain waste within the inner space.

* * * * *